US009020384B2

(12) United States Patent
Kanai

(10) Patent No.: US 9,020,384 B2
(45) Date of Patent: Apr. 28, 2015

(54) IMAGE HEATING APPARATUS CONTROLLING A PERIPHERAL SPEED OF A ROTATABLE DRIVING MEMBER OR A WIDTHWISE POSITION OF AN ENDLESS BELT USING AN OUTPUT OF A DETECTION PORTION

(71) Applicant: Canon Kabushiki Kaisha, Tokyo (JP)

(72) Inventor: Dai Kanai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 13/793,437

(22) Filed: Mar. 11, 2013

(65) Prior Publication Data

US 2013/0243463 A1 Sep. 19, 2013

(30) Foreign Application Priority Data

Mar. 15, 2012 (JP) ..... 2012-058707

(51) Int. Cl.
*G03G 15/20* (2006.01)

(52) U.S. Cl.
CPC ..... *G03G 15/2039* (2013.01); *G03G 15/205* (2013.01); *G03G 15/2053* (2013.01); *G03G 2215/2035* (2013.01)

(58) Field of Classification Search
CPC . G03G 15/20; G03G 15/2053; G03G 15/657; G03G 2215/2035
USPC ..... 399/68, 67, 328, 329, 320
See application file for complete search history.

(56) References Cited

U.S. PATENT DOCUMENTS

| | | | | |
|---|---|---|---|---|
| 5,722,025 | A | 2/1998 | Morigami et al. | |
| 5,869,808 | A * | 2/1999 | Hyllberg | 219/216 |
| 6,408,146 | B1 | 6/2002 | Nagano | |
| 2003/0021616 | A1 * | 1/2003 | Yoda et al. | 399/329 |
| 2011/0293297 | A1 * | 12/2011 | Watanabe et al. | 399/33 |
| 2012/0308255 | A1 * | 12/2012 | Sakai | 399/329 X |
| 2013/0028622 | A1 * | 1/2013 | Nihonyanagi et al. | 399/67 |

FOREIGN PATENT DOCUMENTS

| | | | |
|---|---|---|---|
| JP | 5-35137 | A | 2/1993 |
| JP | 8-127449 | A | 5/1996 |
| JP | 9-114295 | A | 5/1997 |
| JP | 2000-315027 | A | 11/2000 |

* cited by examiner

*Primary Examiner* — Sophia S Chen
(74) *Attorney, Agent, or Firm* — Fitzpatrick, Cella, Harper & Scinto

(57) ABSTRACT

An image heating apparatus includes: an endless belt including a heat generating layer configured to generate heat by electric energy and a conductive layer configured to be electrically connected to the heat generating layer; a rotatable driving member configured to drive the belt and form a nip with the belt; an electric contact portion provided to be in contact with the conductive layer and configured to supply the electric energy to be conductive layer; an electric insulation portion contactable to the electric contact portion with rotation of the belt; a detecting portion configured to detect whether an electric conduction state between the electric contact portion and the conductive layer is in a predetermined state or not when the belt is rotated; and a control portion configured to control a peripheral speed of the rotatable driving member using an output of the detecting portion.

9 Claims, 13 Drawing Sheets

(A)

(B)

IMAGE HEATING APPARATUS CONTROLLING A PERIPHERAL SPEED OF A ROTATABLE DRIVING MEMBER OR A WIDTHWISE POSITION OF AN ENDLESS BELT USING AN OUTPUT OF A DETECTION PORTION

FIELD OF THE INVENTION AND RELATED ART

The present invention relates to an image heating apparatus for heating a toner image on a sheet. This image heating apparatus is usable in an image forming apparatus, such as a copying machine, a printer, a facsimile machine or a multi-function machine, having a plurality of functions of these machines.

In the image forming apparatus, the toner image formed through an electrophotographic process is transferred onto a recording material (sheet) and thereafter is fixed on the recording material by being heated in a fixing device (image heating apparatus).

In recent years, as the fixing device (apparatus), those using a heating roller having a heat generating layer of a material which generates heat by supply of electric energy have been proposed in Japanese Laid-Open Patent Application (JP-A) Hei 9-114295 and JP-A Hei 5-35137. Such a fixing device has the advantage that a full-circumference of the heating roller can be heated in a short time and therefore the waiting time from the time when the main switch of the image forming apparatus is turned on to the start of image formation can be shortened (quick start property). Further, the fixing device also has the advantage that the heating roller itself generates heat, and therefore electric power consumption can be reduced.

Further, in SP-A 2000-315027, a constitution has been proposed in which the above-described heat generating layer is not provided, but a marking is made on a fixing belt (rotatable heating member or endless belt) at an end portion with respect to a widthwise direction thereof, and a sensor for detecting the marking is provided at an opposing portion to the fixing belt to detect the marking, thereby controlling the rotational speed of the fixing belt by such marking detection.

Further, in JP-A Hei 8-127449, a constitution is proposed in which the above-described heat generating layer is not provided, but a sensor for detecting the widthwise position of the fixing belt is provided for controlling lateral deviation (shift) of the fixing belt in a widthwise direction of the fixing belt and then lateral deviation control of the fixing belt is effected on the basis of a detection signal of the sensor.

In the case of the constitutions as proposed in JP-A 2000-315027 and JP-A Hei 8-127449, there is need to provide the sensor for detecting the rotational speed of the fixing belt or the sensor for detecting the widthwise position of the fixing belt, so that there is a possibility that the fixing device is increased in cost and size.

Therefore, in the case where the fixing belt (rotatable heating member) having the heat generating layer which generates heat by supply of electric energy is used, it is required that the rotational speed control of the fixing belt and the lateral deviation control of the fixing belt are effected without causing an increase in cost and size of the fixing device due to the use of the above-described constitutions.

SUMMARY OF THE INVENTION

A principal object of the present invention is to provide an image heating apparatus capable of properly controlling the rotational speed of an endless belt.

Another object of the present invention is to provide an image heating apparatus capable of properly controlling the widthwise position of the endless belt.

A further object of the present invention is to provide an image heating apparatus capable of proper controlling the rotational speed of a rotatable heating member.

According to an aspect of the present invention, there is provided an image heating apparatus comprising: an endless belt configured to heat a toner image on a sheet at a nip, the endless belt including a heat generating layer configured to generate heat by electric energy and a conductive layer confirmed to be electrically connected to the heat generating layer; a rotatable driving member configured to drive the endless belt and form the nip cooperatively with the endless belt; an electric contact portion provided to be in contact with the conductive layer and configured to supply the electric energy to the conductive layer; an electric insulation portion provided at a position where it is contactable to the electric contact portion with rotation of the endless belt and configured to be substantially electrically insulated; a detecting portion configured to defect whether an electric conduction state between the electric contact portion and the conductive layer is in a predetermined state or not when the endless belt is rotated; and a control portion configured to control a peripheral speed of the rotatable driving member using an output of the detecting portion.

According to another aspect of the present invention, there is provided an image heating apparatus comprising: an endless belt configured to heat a toner image on a sheet at a nip, the endless belt including a heat generating layer configured to generate heat by electric energy and a conductive layer configured to be electrically connected to the heat generating layer; an electric contact portion provided to be in contact with the conductive layer and configured to supply the electric energy to the conductive layer; first and second electric insulation portions provided at positions where they are contactable to the electric contact portion with rotation of the endless belt and configured to be substantially electrically insulated, wherein the first and second electric insulation portions are provided so that lengths thereof with respect to a circumferential direction of the fixing belt are different from each other; a detecting portion configured to detect whether an electric conduction state between the electric contact portion and the conductive layer is in a predetermined state or not when the endless belt is rotated; and a control portion configured to control a widthwise length of the endless belt using an output of the detecting portion.

According to a further aspect of the present invention, there is provided an image heating apparatus comprising: a rotatable heating member configured to heat a toner image on a sheet at a nip, the rotatable heating member including a heat generating layer configured to generate heat by electric energy and a conductive layer configured to be electrically connected to the heat generating layer; a rotatable driving member configured to drive the rotatable heating member and form the nip cooperatively with the rotatable heating member; an electric contact portion provided to be in a contact with the conductive layer and configured to supply the electric energy to the conductive layer; an electric insulation portion provided at a position where it is contactable to the electric contact portion with rotation of the rotatable heating member and configured to be substantially electrically insulated; a detecting portion configured to detect whether an electric conduction state between the electric contact portion and the conductive layer is in a predetermined state or not when the rotatable heating member is rotated; and a control portion configured to control a peripheral speed of the rotatable driving member using an output of the detecting portion.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 15 (A) and 15(B) are schematic views each for illustrating positional control of the fixing belt with respect to a widthwise direction of the fixing belt, in which FIG. 15(A) shows a state in which the fixing belt is moved (shifted) in a right direction in the figure, and FIG. 15 (B) shows a state in which the fixing belt is moved (shifted) in a left direction in the figure.

DESCRIPTION OF THE PREFERRED EMBODIMENTS

First Embodiment

A First Embodiment of the present invention will be described with reference to FIGS. 1 to 9. Incidentally, the present invention is not limited to the following embodiments. First, with reference to FIG. 1, a structure of an image forming apparatus in this embodiment will be described.

[Image Forming Apparatus]

Figure 1:
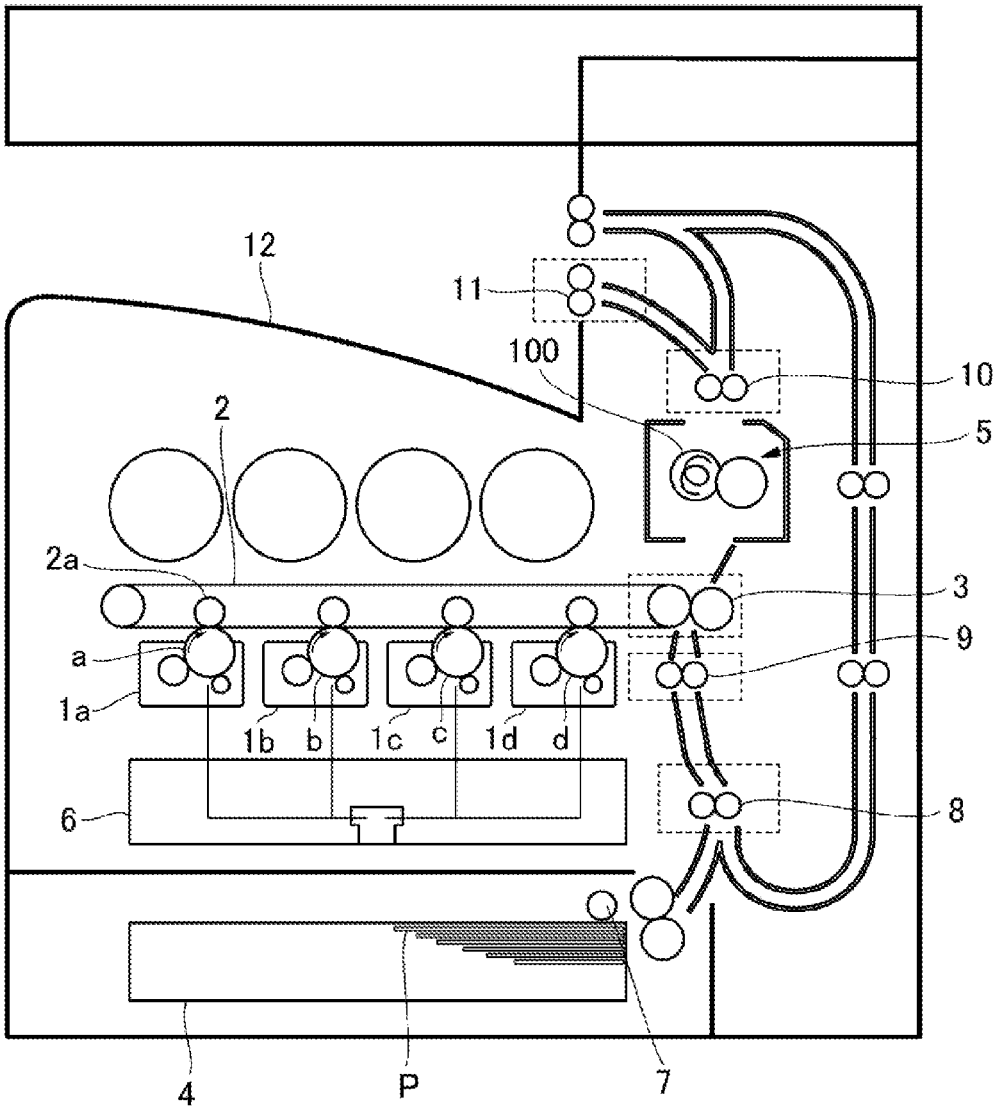
FIG. 1 is a schematic sectional illustration of an image forming apparatus according to First Embodiment of the present invention.

FIG. 1 is a schematic sectional view of the image forming apparatus for effecting color image formation along a conveyance direction of a recording material P. In this embodiment, formation of a color image will be described, but the present invention is also applicable to a monochromatic image.

On the recording material P, a toner image is to be formed. Examples of the recording material P may include plain paper, resinous recording material P to be used as a substitute for the plain paper, thick paper, a recording material P for an overhead projector, and the like. The image forming apparatus in this embodiment is of a tandem type in which, e.g., for image forming portions (image forming stations) for forming toner images of colors of yellow, magenta, cyan and black are juxtaposed. For this reason, four photosensitive drums a (yellow), b (magenta), c (cyan) and d (black) which are an image forming medium (image bearing member) are disposed in parallel to each other. On these photosensitive drums a to d, an intermediary transfer belt 2 as a transferring and conveying means and also another image bearing member is provided along the photosensitive drums a to d.

At a periphery of each of the photosensitive drums a to d driven by an unshown motor, a primary charger (primary charging roller), a developing device and the like are provided and are integrally assembled into a unit as each of process cartridges 1*a* to 1*d*. Further, below the photosensitive drums a to d, an exposure device 6 constituted by a polygonal mirror and the like is provided.

Laser light of a yellow component image signal of an original is projected on the photosensitive drum a via the polygonal mirror and the like of the exposure device 6, so that an electrostatic latent image is formed on the photosensitive drum a. Then, a yellow toner is supplied from the developing device to the electrostatic latent image to develop the electrostatic latent image, so that the electrostatic latent image is visualized. The resultant toner image reaches a primary transfer position, where the photosensitive drum a and the intermediary transfer belt 2 are in contact with each other, with rotation of the photosensitive drum a. Then, by a primary transfer bias applied to a transfer charging member 2*a*, the yellow toner image is transferred from the photosensitive drum a onto the intermediary transfer belt 2 (primary transfer). A portion of the intermediary transfer belt 2 where the yellow toner image is carried is moved to a downstream image forming portion with respect to the rotational direction of the intermediary transfer belt 2. Then, until this time, a magenta toner image is formed on the photosensitive drum b at the image forming portion in the same manner as that described above, and then the magenta toner image is transferred onto the yellow toner image on the intermediary transfer belt 2. Similarly, a cyan toner image and a black toner image are superposedly transferred onto the yellow toner image and the magenta toner image.

On the other hand, sheets of the recording material P are accommodated in a cassette 4. The sheets of the recording material P are fed one by one from the cassette 4 by a pick-up roller 7 and then the recording material P is sent to a registration roller pair 9 in a rest (rotation stop) state by a pre-registration conveyance roller pair 8. The recording material P having reached the registration roller pair 9 is subjected to rectification of oblique movement at its end by the registration roller pair 9, and then reaches a secondary transfer portion by the registration roller pair 9 which starts its rotation at predetermined timing. Then, by a secondary transfer bias applied to a secondary transfer roller pair 3 constituting a secondary transfer portion, the four color toner images are collectively transferred from the intermediary transfer belt 2 onto the recording material P (secondary transfer).

The recording material P on which the four color toner images are transferred is guided by a conveyance guide between the secondary transfer roller pair 3 and a fixing device 5 as the image heating apparatus, thus being conveyed into the fixing device 5. In the fixing device 5, the recording material P is heated and pressed, so that the respective color toners are melt-mixed and fixed on the recording material P. Then, the recording material P on which a full-color print image is fixed is discharged onto a sheet discharge tray 12 by conveying roller pairs 10 and 11.

[Fixing Device}

Figure 2:
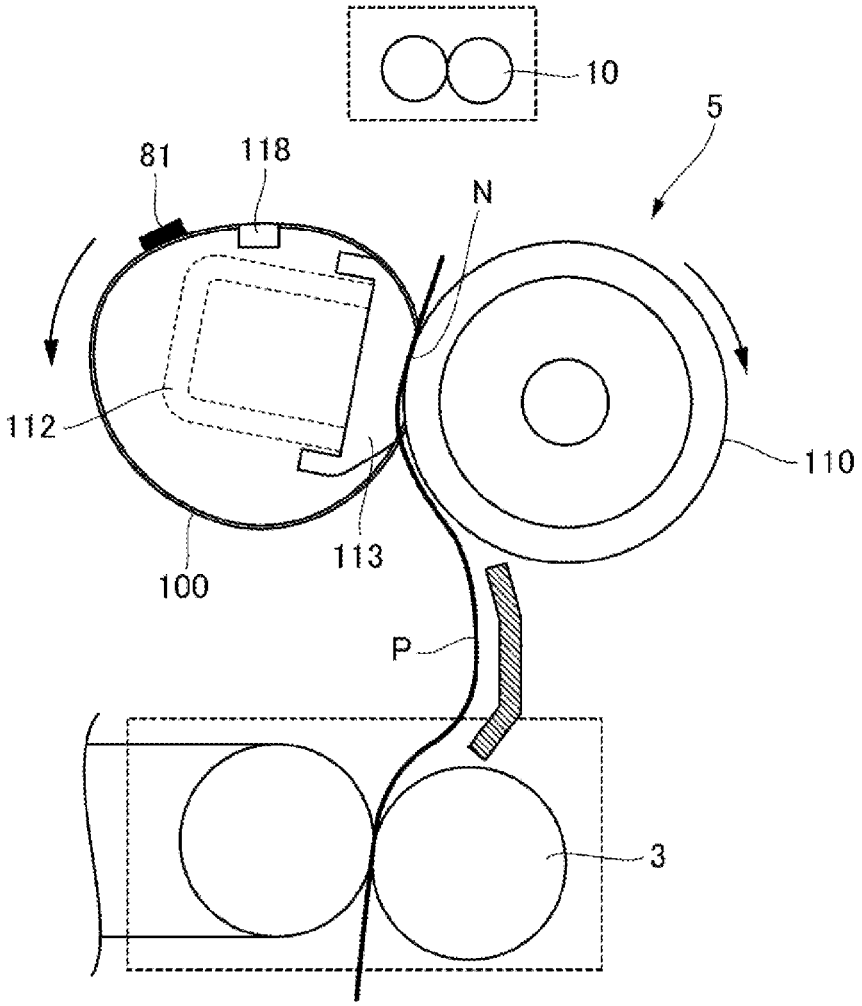
FIG. 2 is a schematic view showing a fixing device and a transfer portion in First Embodiment.
Figure 3:
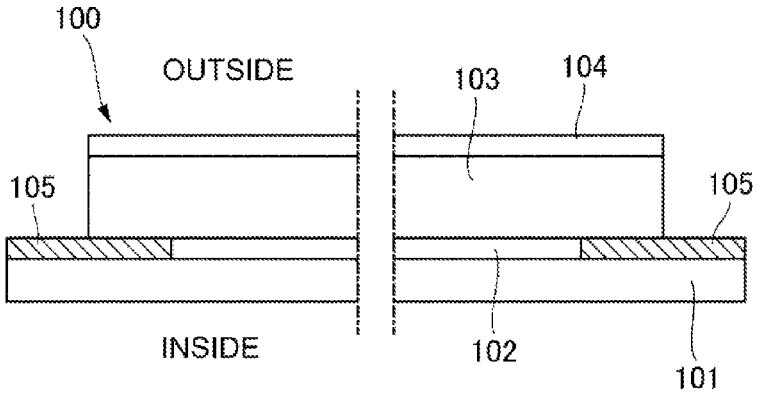
FIG. 3 is a schematic sectional illustration of a part of the fixing belt in First Embodiment.

Next, a schematic structure of the fixing device (image heating apparatus) 5 in this embodiment will be described. As shown in FIG. 2, the fixing device 5 includes a fixing belt 100, which is a rotatable heating member (endless belt), and a pressing roller 110, which is a rotatable driving member for forming a fixing nip between itself and the fixing belt 100, and heats the image on the recording material P by the fixing belt 100. The fixing belt 100 is the endless belt and includes, as shown in FIG. 3, a heat generating resistance layer 102, which generates heat by supply of electric energy, and an electrode portion (electroconductive layer) 105, which conducts electricity to the heat generating resistance layer 102, and is rotationally driven by rotation of the pressing roller 110. Such a fixing device 5 will be described specifically with reference to FIG. 3.

The fixing belt 100 has a four-layer composite structure including, from its inner peripheral side to its outer peripheral side, a base layer 101, the heat generating resistance layer 102, an elastic layer 103 and a parting layer 104. Further, at an end portion with respect to a widthwise direction, the electrode portion 105 for supplying electric energy to the heat generating resistance layer 102 is provided. Incidentally, the "widthwise direction" is a direction crossing (substantially perpendicular to) the rotational direction of the fixing belt 100 and refers to, e.g., a left-right direction in FIGS. 3 and 4.

The base layer 100 can be formed of a heat resistant material of thickness of 100 μm or less, preferably 50 μm less and 20 μm or more, in order to decrease the thermal capacity to improve the quick start property of the belt 100. For example, as the base layer 101, it is possible to use a resin belt of, e.g., polyimide, polyimideamide, PEEK, PTFE, PFA, FEP, or the like or to use a metal belt of SUS, nickel, or the like. In this embodiment, a cylindrical polyimide belt of 30 μm in thickness and 25 mm in diameter was used. Incidentally, in the case where an electroconductive material is used for forming the base layer 101, there is a need to provide an insulating layer of polyimide or the like between the base layer 101 and the heat generating resistance layer 102.

The elastic layer 103 is formed of a synthetic resin material, such as an elastic rubber material (e.g., silicone rubber), and is provided on an outer peripheral surface of the base layer 101. In this embodiment, a silicone rubber of 10 degrees in (JIS-A) rubber hardness, 1.3 W/m·K in thermal conductivity, and 300 μm in thickness was used. The parting layer 104 is constituted by a fluorine-containing resin, such as PFA, and is provided so as to cover an outer peripheral surface of the elastic layer 103. In this embodiment, a PFA tube of 20 μm in thickness was used. As the parting layer 104, a PFA coating layer may also be used, and it is possible to selectively use the PFA tube and the PFA coating layer, depending on its mechanical strength and electrical strength. Further, the parting layer 104 is bonded to the elastic layer 103 by an adhesive consisting of a silicone resin material.

The heat generating resistance layer 102 is a heat generating resistance member prepared by dispersing particles having electroconductivity. In this embodiment, the heat generating resistance layer 102 is constituted by applying a polyimide resin material containing carbon black as the electroconductive particles on an outer peripheral surface of the base layer 101 in a uniform thickness at an intermediary portion with respect to the widthwise direction of the base layer 101. The total resistance value of the heat generating resistance layer 102 is 10.0Ω. Therefore, electric power generated during the application of a voltage of 100 V from an AC voltage source (power source) is 1000 W. Incidentally, this resistance value may be appropriately determined by the amount of heat generation necessary for the fixing device 5 and can be appropriately adjusted depending on the mixing ratio of the carbon black.

The electrode portion 105 is provided on the peripheral surface of the fixing belt 100 at each of widthwise end portions at predetermined positions and is electrically connected to an associated one of widthwise ends of the heat generating resistance layer 102. Such an electrode portion 105 is formed in a cylindrical shape by using an electro conductive material containing silver and palladium. Further, the electrode portion 105 is disposed on the base layer 101 at each of widthwise end portions and is electrically conducting with the heat generating resistance layer 102. Further, a part of the outer peripheral surface of the electrode portion 105 is exposed with its full circumference at a position outside the elastic layer 103 and the parting layer 104. To the exposed portion of the electrode portion 105, an electric energy supplying member (electric contact portion) 81 described later is contacted.

Figure 4:
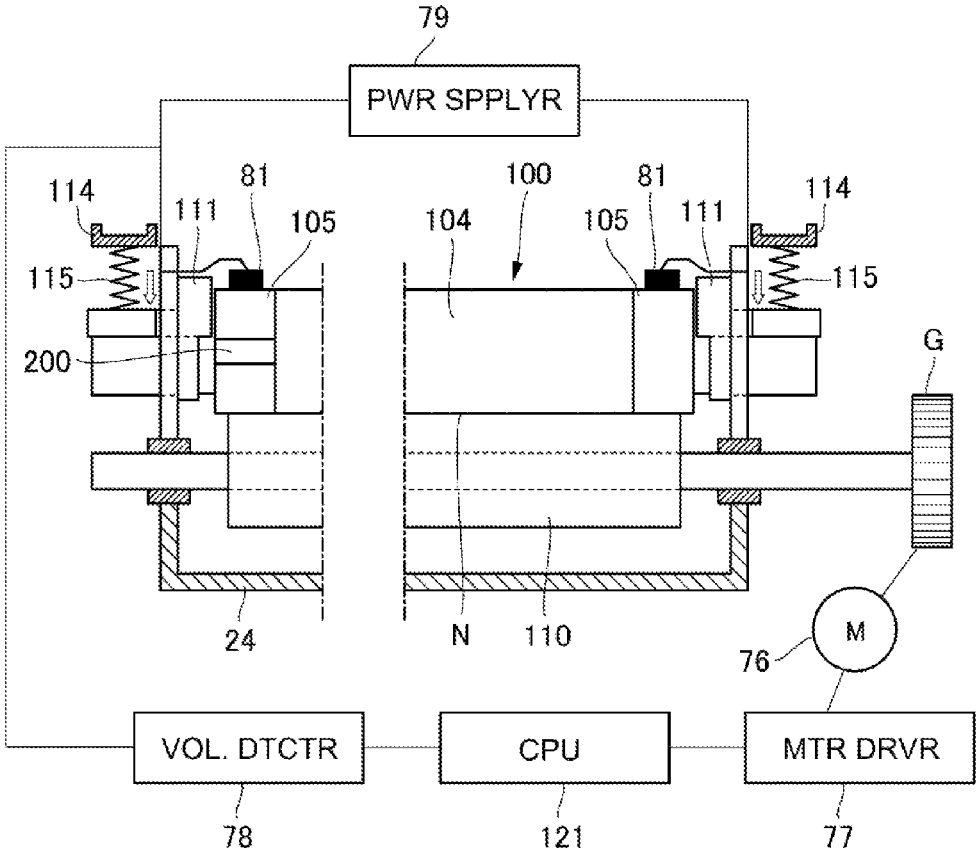
FIG. 4 is a schematic illustration of the fixing device as seen in a recording material conveyance direction in First Embodiment.

The thus constituted fixing belt 100 is, as shown in FIG. 4, supported movably toward and away from the pressing roller 110 by a fixing portion of the apparatus and is also supported by a pair of fixing flanges 111 provided at end portions of the fixing belt 100. The pair of fixing flanges 111 regulates (limits) widthwise (longitudinal) movement and circumference shape of the fixing belt 100. That is, end portions of the fixing belt 100 are inserted into cylindrical surface portions of the fixing flanges 111, so that the circumferential shape of the fixing belt 100 is regulated. Further, edge portions of the fixing belt 100 abut against wall surfaces of the fixing flanges 111 formed perpendicular to an axial direction, so that the widthwise movement of the fixing belt 100 is limited (prevented). The interval between opposing wall surfaces of the pair of the fixing flanges 111 is made larger than the length of the fixing belt 100 with respect to the widthwise direction of the fixing belt 100.

Inside the fixing belt 100, as shown in FIG. 2, a supporting stay 112 is supported by the fixing flanges 111 at its widthwise end portions. The supporting stay 112 is constituted by a material having sufficient rigidity, such as metal and supports a nip forming member 113 for urging the fixing belt 100 toward the pressing roller 110. The nip forming member has heat resistance and is formed of a resin material having an excellent sliding property, and urges the fixing belt 100 toward the pressing roller 110 while sliding on the inner peripheral surface of the fixing belt 100, thus forming a fixing nip between the fixing belt 100 and the pressing roller 110.

In order to urge the nip-forming member 113, as shown in FIG. 4, an urging (pressing) spring 115 is provided in an elastically compressed state between an associated one of the fixing flanges 111 and an urging (pressing) arm 114. As a result, the fixing belt 100 is pressed against the pressing roller 110 via the pair of the fixing flanges 111, the supporting stay 112 and the nip-forming member 113 under the application of predetermined pressure (urging force), so that the fixing nip N has a predetermined width. In this embodiment, as the predetermined pressure, 156.8 N is the pressure at one side, and thus 313.6 N (32 kgf) is applied as total pressure in both sides.

Incidentally, the supporting stay 112 may desirably formed of a material, such as stainless steel, which is not readily bent even under the application of high pressure, and in this embodiment, SUS 304 is used. Further, the nip-forming member 113 is formed in a substantially semi-circular trough-like shape in cross section and is a heat insulating member, which is formed of a heat resistant resin material or the like and which extends in a longitudinal direction perpendicular to the drawing surface of FIG. 2.

The nip-forming member 113 may desirably be formed of a material which poorly conducts the heat to the supporting stay 112 from the viewpoint of energy saving and may be formed of, e.g., heat-resistant glass or heat-resistant resin such as polycarbonate or liquid crystal polymer. In this embodiment, as the material, "SUMIKA SUPER E5204L", mfd. by Sumitomo Chemical Company was used.

Further, the pressing roller 110 has a multi-layer structure formed by laminating, on a stainless steel-made metal core, a silicone rubber layer of about 3 μm in thickness and a PFA resin tube of about 50 μm in thickness in this order. End portions of the metal core of the pressing roller 110 rotatably shaft-supported and held between side plates of an apparatus frame 24.

A thermistor 118 as a temperature detecting means is provided as shown in FIG. 2.

The thermistor 118 is disposed above the supporting stay 112 so as to be elastically contacted to the inner surface of the fixing belt 100 and has the function of detecting a temperature of the inner surface of the fixing belt 100. Specifically, the thermistor 118 is mounted on an end portion of a stainless steel arm fixed and supported on the supporting stay 112. Further, the arm is elastically swung, so that the thermistor 118 is kept in the state in which the thermistor 118 is always contacted to the inner surface of the fixing belt 100 even in a state in which motion of the inner surface of the fixing belt 100 becomes unstable.

The thermistor 118 is connected to the CPU 121 (control circuit portion) as a control means through an unshown A/D converter. This CPU 121 samples an output from the thermistor 118 at a predetermined interval, and the resultant temperature information is reflected in the electric energy supply (energization) control of the heat generating resistance layer 102. That is, the CPU 121 determines the contents of the control of the electric energy supply to the heat generating resistance layer 102 using the output of the thermistor 118 and controls the electric energy to be supplied from a (main) power supplying portion 79 to the heat generating resistance layer 102 of the fixing belt 100 via the electric energy supplying member 81 and the electrode portion 105. In the control by the fixing device 5 in this embodiment, in view of a temperature for fixing the toner image on the recording material P, a detection temperature of the thermistor 118 is controlled to be kept at a constant value of 160° C.

The pressing roller 110 is rotationally driven in an arrow direction in FIG. 2 by transmission of rotation of a fixing motor 76 as a driving mechanism via a reduction gear G. The fixing belt 100 in a press-contact relationship with the pressing roller 110 is rotated by the rotation of the pressing roller 110. Grease is applied onto the inner surface of the fixing belt 100 to reduce the degree of abrasion of the inner surface of the fixing belt 100 generated due to friction between the inner surface of the fixing belt 100 and a nip-forming member 113 as a back-up member.

The pressing roller 110 is rotationally driven and by the rotation, when the cylindrical fixing belt 100 is rotated, the electric energy is supplied to the heat generating resistance layer 102. Then, when the temperature of the fixing belt 100 is raised to a set temperature, in the fixing nip N, the recording material P on which unfixed toner images transferred by a secondary transfer roller pair 3 (secondary transfer portion) are carried is guided and introduced.

In the fixing nip N, the toner image carrying surface of the recording material P intimately contacts the outer surface of the fixing belt 100, so that the recording material P moves together with the fixing belt 100. In a nip-conveying process of the recording material P in the fixing nip N, the heat generated by the heat generating resistance layer 102 is applied to the recording material P, so that the unfixed toner images are melted and fixed on the recording material P. The recording material P having passed through the fixing nip N is separated by curvature and then is discharged by a conveying belt pair 10 as fixing discharge rollers.

The electrode portion 105 contacts the electric energy supplying member 81, which is electrically connected to the power supplying portion 79. The electric energy supplying member 81 is leaf spring-shaped member of stainless steel and contacts the peripheral surface of the rotating electrode portion 105 while sliding on the electrode portion peripheral surface. The electric energy supplying member 81 supplies electricity (electric energy) to the heat generating resistance layer 102 via the electrode portion 105. A portion of the electric energy supplying member 81 contacting the electrode portion 105 is constituted by a member, such as a carbon chip or the like, having an excellent sliding property. The thus-constituted electric energy supplying member 81 is pressed against the electrode portion 105, so that electrical connection is satisfactorily maintained.

Further, between the power supplying portion 79 and the electric energy supplying member 81, a voltage detecting portion 78, functioning as a detecting portion for detecting a voltage to be applied to the electric energy supplying member 81, is provided. In this embodiment, the voltage detecting portion 78 detects whether or not an electric conduction state between the electric energy supplying member 81 and the electrode portion 105 is in a predetermined electric conduction state. Specifically, the voltage detecting portion 78 detects whether the electric conduction state between the electric energy supplying member 81 and the electrode portion 105 is in the predetermined electric conduction state (corresponding to contact with the electrode portion) or in an electric non-conduction state (corresponding to contact with an electric insulation portion). Incidentally, in order to detect the electric energy supply state, a current may also be detected.

Further, in this embodiment, as shown in FIG. 4, at a part of the peripheral surface of one of the electrode portions 105, an electric insulation portion 200, which is a portion different in electric characteristic from the remaining portion of the electrode portion 105, is provided. Incidentally, this portion may be a portion that is not a complete electric insulation portion and may also be constituted so that it slightly conducts the electric energy and is substantially electrically insulative. Further, a detected voltage value (or detected current value) when the electric energy supplying member contacts the electrode portion may only be required to be that when the electric energy supplying member contacts the electric insulation portion.

As the electric insulation portion 200, an electric insulation member formed of a resin material with an excellent sliding property is used. Further, the electric insulation portion 200 can be prepared by forming a recessed portion, corresponding to a shape of the electric insulation portion 200, at a part of the electrode portion 105 and then by engaging the electric insulation portion 200 in the recessed portion. In this case, it is preferable that an outer peripheral surface of the electric insulation portion 200 and an outer peripheral surface are present at the same circumferential surface. Alternatively, an electric insulation sheet may be applied onto a part of the electrode portion 105.

In either case, a constitution is employed in which the voltage is applied to the fixing belt 100 when the electric energy supplying member 81 contacts the electrode portion 105 to generate heat and electric conduction is not established when the electric energy supplying member 81 contacts the electric insulation portion 200.

Incidentally, the electric insulation portion 200 may also be a portion which cannot establish complete electric insulation. In this case, a voltage value (or a current value) at the time when the electric energy supplying member 81 contacts the electric insulation portion 200 may only be required to be smaller than a voltage value (or a current value) at the time when the electric energy supplying member 81 contacts the electrode portion 105.

[Rotational Speed Detection of Fixing Belt]

Next, rotational speed detection of the fixing belt 100 in this embodiment will be described. As described above, the part of the outer peripheral surface of one of the electrode portions 105 constitutes the electric insulation portion 200. For this reason, the electric energy supplying member 81 contacts each of the electrode portion 105 and the electric insulation portion 200 every one rotation of the fixing belt 100. Accordingly, when contact of the electric energy supplying member 81 with the electric insulation portion 200 can be detected, it is possible to grasp a rotational characteristic of the fixing belt 100.

In this embodiment, each electric energy supply state between the electric energy supplying member 81 and the electric insulation portion 200 and between the electric energy supplying member 81 and the electrode portion 105 is detected, so that the contact of the electric energy supplying member 81 with the electric insulation portion 200 is detected. That is, when the electric energy supplying member 81 and the electrode portion 105 are in contact with each other, the voltage is applied to the fixing belt 105 to generate heat, but when the electric energy supplying member 81 and the electric insulation portion 200 are in contact with each other, the electric conduction is not established. For this reason, for every one rotation of the fixing belt 100, the electric energy supply state between the electric energy supplying member 81 and the electrode portion 105 is changed. In this embodiment, the electric insulation portion 200 is provided at one position with respect to a circumferential direction, and therefore the electric energy is not supplied once every one rotation. Incidentally, the electric insulation portion 200 may also be provided at a plurality of positions with respect to the circumferential direction.

Figure 5:
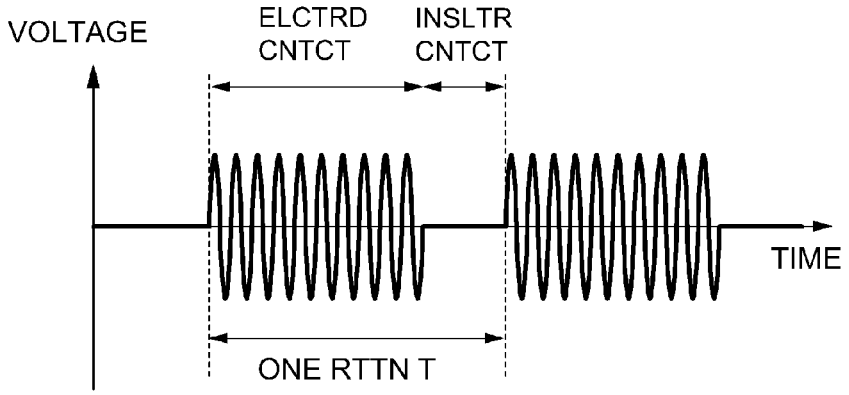
FIG. 5 is a schematic view showing a relationship between a time and a detection signal detected by a voltage detecting portion during rotation of the fixing belt in the case where a power (voltage) supplying portion is an AC power (voltage) source.

The power supplying portion 79 is an AC power source and therefore a voltage signal detected by the voltage detecting portion 78 is, as shown in FIG. 5, an AC waveform when the electric energy supplying member 81 contacts the electrode portion 105. On the other hand, when the electric energy supplying member 81 contacts the electric insulation portion 200, the electricity is not conducted and therefore there is no voltage waveform. The AC waveform time and the no electric conduction time constitute one rotation time T, so that a rotational speed of the fixing belt 100 is calculated by the CPU 121 from a circumferential length of the fixing belt 100 and the one rotation time T. Accordingly, in this embodiment, the CPU 121 corresponds to a rotational speed calculating means.

Figure 6:
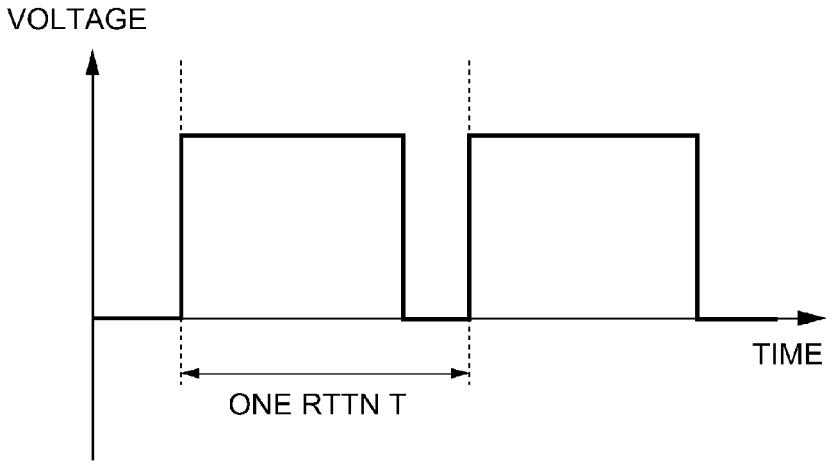
FIG. 6 is a schematic view showing a relationship between time and a detection signal detected by a voltage detecting portion during rotation of the fixing belt in the case where a power supplying portion is a DC power source.

In the case where the power supplying portion 79 is a DC power source, the voltage detected by the voltage detecting portion 78 is, as shown in FIG. 6, a rectangular signal, but the calculation of the rotational speed can be performed similarly as in the case of the AC power source. Further, the length of the electric insulation portion 200 with respect to the rotational direction may desirably be such that a length portion corresponding to at least one or two phases of the AC waveform is not electrically conductive in the case where the power supplying portion 79 is the AC power source.

Figure 7:
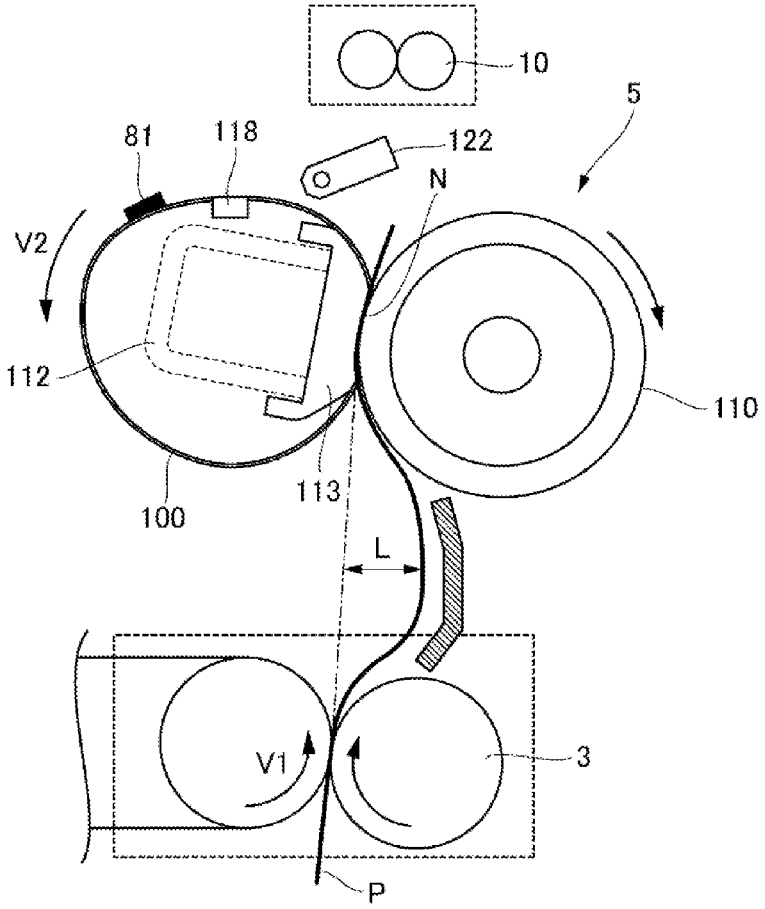
FIG. 7 is a schematic view showing a recording material conveyance state between a fixing device and a transfer portion.

In this embodiment, as described above, based on the rotational speed of the fixing belt 100 calculated by the CPU 121, a driving speed of the fixing motor 76 for driving the pressing roller 100 is controlled via a motor driver 77. Further, as shown in FIG. 7, the rotational speed of the fixing belt 100 is controlled so that a loop (bending) amount L of the recording material P between the secondary transfer roller pair 3 and the fixing device 5 is within a predetermined range.

[Rotational Speed Control of Fixing Belt]

Next, rotational speed control of the fixing belt 100 as described above will be described with reference to FIGS. 7 to 9. In an image forming process, it is preferable that when the toner image is transferred onto the recording material P by the secondary transfer roller pair 3, the peripheral speed (rotational speed) V2 of the fixing belt 100 is made slower than the recording material conveyance speed (rotational speed) of the secondary transfer roller pair 3. Further, the recording material P may desirably maintain a predetermined loop amount L between the secondary transfer portion and the fixing nip N.

Here, by temperature rise of the pressing roller 110 with the actuation (drive) of the fixing device 5, the pressing roller 110 is increased in outer diameter with expansion of the rubber layer. The pressing roller 110 is normally rotationally driven at a certain rotation number, and therefore the outer diameter thereof becomes larger during high temperature than during low temperature, and thus correspondingly, the rotational speed is increased and the recording material conveyance speed becomes fast. For this reason, during high temperature, there is a possibility that the fixing speed becomes higher than a transfer conveyance speed in a state in which a leading end of the recording material is conveyed at the nip of the fixing device 5 during image transfer between the secondary transfer roller pair 3 as a treating portion provided upstream of the fixing device 5. That is, there is a possibility that the recording material conveyance speed of the fixing belt 100 becomes higher than the recording material conveyance speed of the secondary transfer roller pair 3. Further, in this case, the fixing device 5 pulls the recording material and by this influence, image blur is generated at the secondary transfer portion. Accordingly, the rotational speed of the fixing belt 100 may preferably be controlled so that the recording material P can maintain the predetermined loop amount L between the secondary transfer portion and the fixing nip N.

Figure 8:
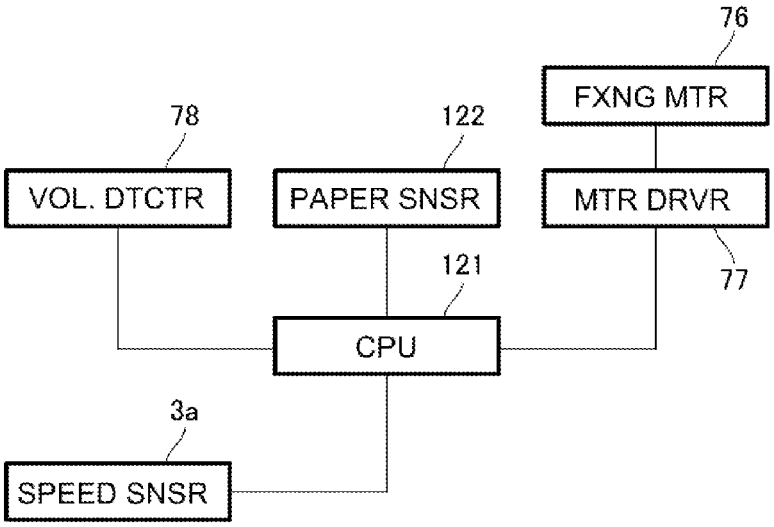
FIG. 8 is a block diagram of rotational speed control of the fixing belt in First Embodiment.

For this purpose, in this embodiment, as shown in FIG. 8, the CPU 121 is connected with the voltage detecting portion 78, a paper detecting sensor 122, the motor driver 77 and a rotational speed sensor 3*a*. The voltage detecting portion 78 detects, as described above, the electric conduction state between the electric energy supplying member 81 and the electrode portion 105, and the CPU 121 calculates the rotational speed of the fixing belt 100 on the basis of this detection signal. The paper detecting sensor 122 is positioned downstream of the recording material conveyance direction, and detects passing of the recording material through the fixing nip N. The motor driver 77 controls the fixing motor 76 on the basis of the instructions from the CPU 121. In this embodiment, the CPU 121 and the motor driver 77 correspond to a control means (control portion or controller). The rotational speed sensor 3*a* detects the rotational speed of the secondary transfer roller pair 3. For example, an encoder is provided to a rotation shaft of either one of the secondary transfer roller pair 3, and the CPU 121 calculates the rotational speed of the secondary transfer roller pair 3 from a signal of the encoder. Incidentally, without calculating the rotational speed, the rotational speed of the fixing motor 76 may also be controlled by using an output of the voltage detecting portion 78, e.g., by making reference to a table.

Figure 9:
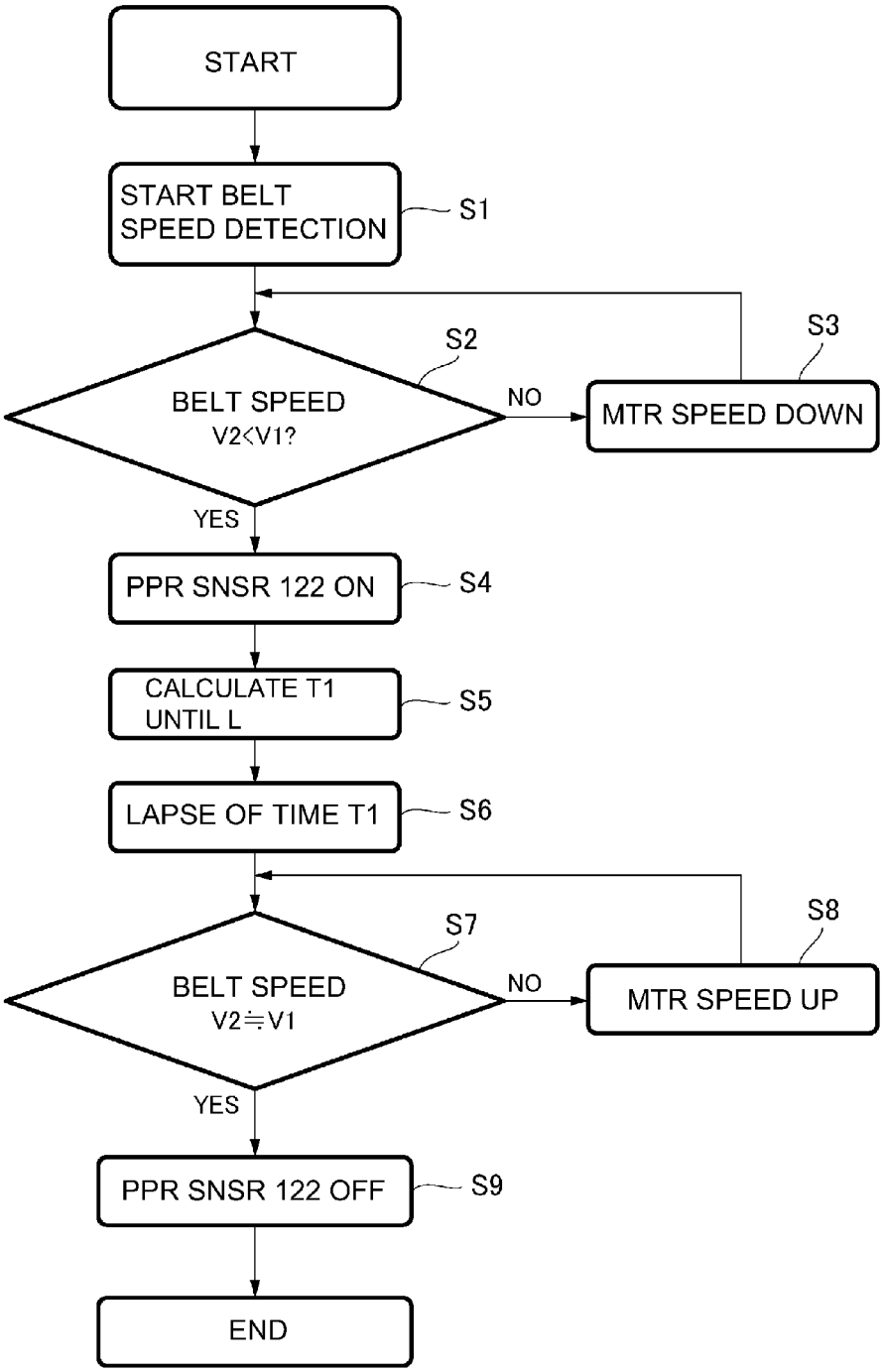
FIG. 9 is a flow chart of the rotational speed control of the fixing belt in the First Embodiment.

The rotational speed control of the fixing belt 100 is effected along a flow, e.g., as shown in FIG. 9. First, after a main assembly operation is started, detection of the rotational speed of the fixing belt 100 by the voltage detecting portion 78 and detection of the rotational speed of the secondary transfer roller pair 3 by the rotational speed sensor 3*a* are started (S1). Then, the CPU 121 discriminates whether or not the rotational speed V2 of the fixing belt 100 is slower than the rotational speed V1 of the secondary transfer roller pair 3 (S2). For example, in the case where the rotational speed V2 of the fixing belt 100 is faster than the rotational speed V1 of the secondary transfer roller pair 3 due to thermal expansion of the pressing roller 110, the speed of the fixing motor 76 is made slow via the motor driver 77 (S3).

The leading end of the recording material P passes through the fixing nip N, and the paper detecting sensor 122 detects the recording material leading end ("ON" of the paper detecting sensor 122) (S4). At this time, from the recording material conveyance speed V1 of the secondary transfer roller pair 3 and the rotational speed V2 of the fixing belt 100, the CPU 121 calculates a time T1 required until the recording material P provides the predetermined loop amount L between the secondary transfer roller pair 3 and the fixing nip N (S5). After, a lapse of the time T1 (S6), the fixing motor 76 is controlled so that the recording material conveyance speed V1 of the secondary transfer roller pair 3 and the rotational speed V2 of the fixing belt 100 can be made the same in order to maintain the loop amount L (S7). In this case, the speed of the fixing motor 76 is made slow in S3, control is effected such that the speed of the fixing motor 76 is made fast (S8). This rotational speed control of the fixing belt 100 is effected until the paper detecting sensor 122 is turned off ("OFF"), i.e., a trailing end of the recording material P passes through the paper detecting sensor 122 (S9). Such control is effected for every recording material P to be continuously subjected to sheet passing.

According to this embodiment, the voltage detecting portion 78 detects the electric energy supply state between the electric energy supplying member 81 and the electric insulation portion 200, so that the contact of the electric energy supplying member 81 with the electric insulation portion 200 provided at a part of the peripheral surface of the electrode portion 105 can be detected. For this reason, without separately providing a sensor, the rotational speed of the fixing belt 100 can be detected as described above. As a result, it becomes possible to detect the rotational speed of the fixing belt 100 in a structure in which the fixing device 5, and by extension to the image forming apparatus, can be downsized.

Second Embodiment

Figure 10:
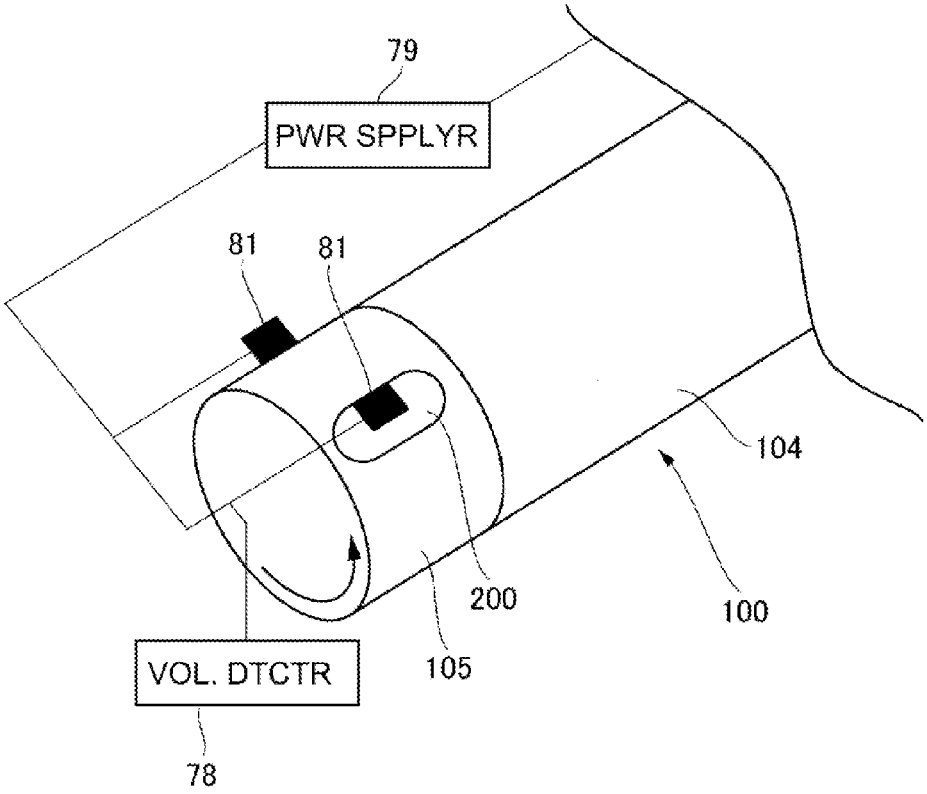
FIG. 10 is a schematic perspective view showing a fixing belt and a constitution relating to supply of electric energy (voltage) in the Second Embodiment of the present invention.

The Second Embodiment of the present invention will be described with reference to FIG. 10. In a constitution of this embodiment, in addition to the constitution of the First Embodiment described above, another electric energy supplying member 81 contactable to the electrode portion 105 in the side where the electric insulation portion 200 is provided is added. That is, a plurality of electric energy supplying members 81 are provided with respect to the circumferential direction of the fixing belt 100. In FIG. 10, two electric energy supplying members 81 are disposed. In the following, constituent elements (portions) that are the same as those in the First Embodiment are represented by the same reference numerals or symbols to omit or simplify description thereof, and the description will be made principally with respect to a difference from First Embodiment.

As shown in FIG. 10, even when one of the electric energy supplying members 81 contacts the electric insulation portion 200, another electric energy supplying member 81 contacts the electrode portion 105. For this reason, it is possible to supply the electric energy from the power supplying portion 79 to the fixing belt 100 with no loss. Further, the rotational speed detection of the fixing belt 100 can be made by detecting the electric energy supply state of one of the electric energy supplying members 81 by the voltage detecting portion 78 and thus can be made similarly as in First Embodiment.

Third Embodiment

The Third Embodiment of the present invention will be described with reference to FIGS. 11 to 17. In this embodiment, different from the First and Second Embodiments described above, a widthwise position (lateral deviation (shift) position) of the fixing belt 100 is detected by detecting contact of the electric energy supplying member 81 with the electric insulation portion 200. Then, lateral deviation control is effected. In the following, constituent elements (portions) that are the same as those in the First and Second Embodiments are represented by the same reference numerals or symbols to omit or simplify the description thereof, and the description will be made principally with respect to a difference from the First and Second Embodiments.

In the fixing device 5 of a type in which the fixing belt 100 travels, the fixing belt 100 is laterally deviated (shifted) toward either one of ends of an axial direction in some cases due to mechanical non-uniformity of the apparatus, slight deviation between the rotation shaft of the fixing belt 100 and the rotation shaft of the pressing roller 110, and the like. When the lateral deviation of the fixing belt 100 is left standing as it is, the degree of the lateral deviation of the fixing belt 100 becomes large, so that the fixing belt 100 abuts against a belt supporting member (wall surface of the fixing flange 111). At this time, when a force with respect to a lateral deviation direction is excessively exerted on the fixing belt 100, creases are generated on the fixing belt 100, so that there is a possibility that good fixing cannot be effected. Further, there is also a possibility that breakage of the fixing belt 100 is generated. Therefore, in this embodiment, the lateral deviation of the fixing belt 100 is detected in the following manner, and then the lateral deviation control of the fixing belt 100 is effected.

[Lateral Deviation Detection of Fixing Belt]

Figure 11:
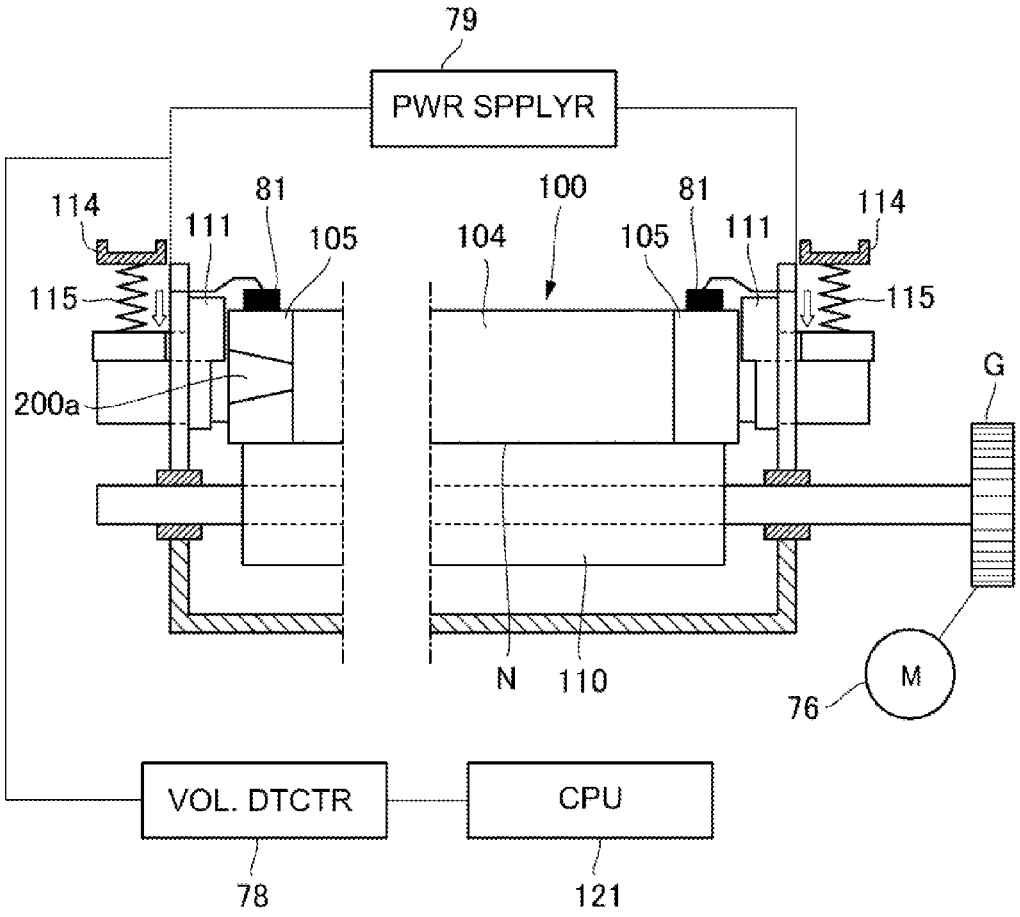
FIG. 11 is a schematic illustration of a fixing device as seen in a recording material conveyance direction in the Third Embodiment of the present invention.
Figure 12:
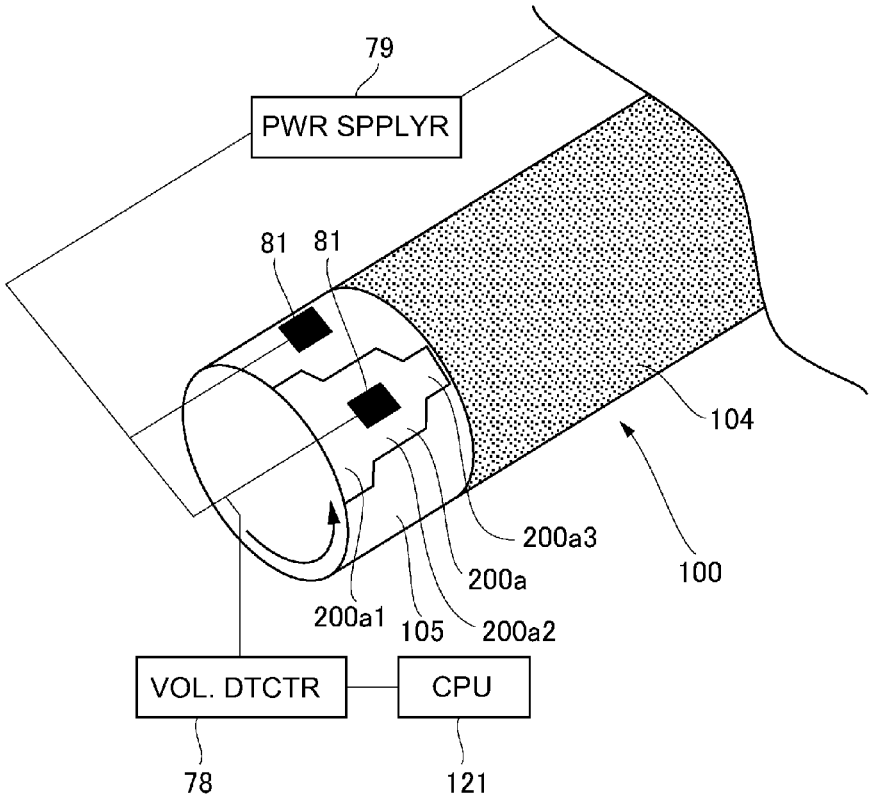
FIG. 12 is a schematic perspective view showing a fixing belt and a constitution relating to supply of electric energy in the Third Embodiment.

In this embodiment, an electric insulation portion 200*a* provided at the outer peripheral surface of one of the electrode portions 105 is changed in length with respect to a rotational direction at least at two positions with respect to the widthwise direction. In this embodiment, as shown in FIGS. 11 and 12, a shape is provided such that the length of the electric insulation portion 200*a* with respect to the rotational direction is changed with respect to the widthwise direction. In FIG. 11, the shape of the electric insulation portion 200*a* is substantially trapezoidal, but can be changed to other shapes, such as a triangular shape and a semicircular shape. Further, as shown in FIG. 12, a shape different in length with respect to the rotational direction may also be disposed along the widthwise direction. That is, the electric insulation portion 200*a* is constituted by a plurality of electric insulation portions 200*a*1, 200*a*2 and 200*a*3 which are provided so that they are provided at different widthwise positions of the fixing belt 100 in different lengths with respect to the rotational direction.

Further, with respect to the widthwise direction, the number of electric insulation portions with respect to the rotational direction may also be changed. In other words, by changing the number of the electric insulation portions, the lengths of the electric insulation portions with respect to the rotational direction may also be mode different from each other with respect to the widthwise direction. For example, a single electric insulation portion may be provided at a first position with respect to the widthwise direction and two electric insulation portions may be provided at a second position deviated from the first position with respect to the widthwise direction. Further, electric insulation portions are provided intermittently at different positions with respect to the rotational direction, and the lengths, with respect to the rotational direction, in regions in which the electric insulation portions are provided intermittently may also be changed at the respective positions.

Also in this embodiment, similarly as in the above-described embodiments, when the electric energy supplying member 81 contacts the electrode portion 105, a voltage is applied to the fixing belt 100 to generate heat and when the electric energy supplying member 81 contacts the electric insulation portion 200*a*, the electric conduction is not established. Further, as shown in FIG. 12, similarly as in Second Embodiment described above, two electric energy supplying members 81 contactable to the electrode portion 100 where the electric insulation portion 200*a* is provided are disposed with respect to the rotational direction.

Figure 13:
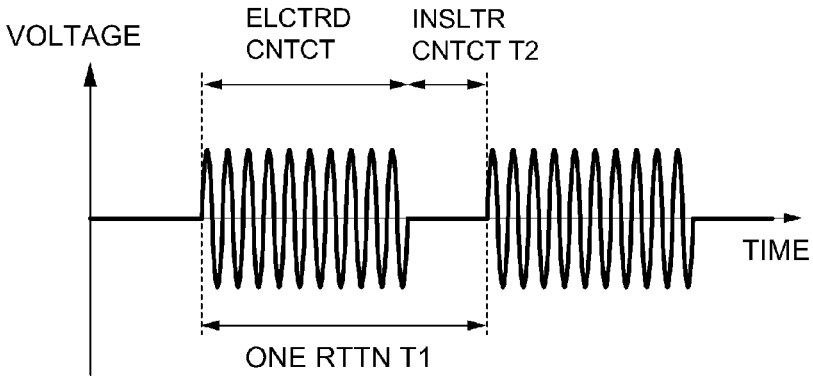
FIG. 13 is a schematic view showing a relationship between a time and a voltage signal detected by a voltage detecting portion during rotation of the fixing belt.

Further, also in this embodiment, for every one rotation of the fixing belt 100, each electric energy supplying member 81 contacts the electrode portion 105 and the electric insulation portion 200*a*, so that a voltage signal detected by the voltage detecting portion 78 is as shown in FIG. 13. That is, an AC waveform is formed when the electric energy supplying member 81 contacts the electrode portion 105, and there is no voltage waveform when the electric energy supplying member 81 contacts the electric insulation portion 200*a* since the electric conduction 1 is not established.

Here, the sum of the AC waveform time and a time of no electric conduction is taken as one rotation time T1, and the time of no electric conduction in which the electric energy supplying member 81 contacts the electric insulation portion 200*a* is taken as T2. In this case, T2/T1 is changed due to a difference with respect to the widthwise direction in length of the electric insulation portion 200*a* with respect to the rotational direction. In this embodiment, as described above, the layer of the electric insulation portion 200*a* with respect to the rotational direction is changed with respect to the widthwise direction, and therefore when the value of T2/T1 is grasped, the position of the fixing belt 100 with respect to the widthwise direction can be obtained.

For this reason, the value of T2/T1 is calculated from a signal detected by the voltage detecting portion 78 and from this value, the widthwise position of the fixing belt 100 is specified (detected). Accordingly, in this embodiment, the CPU 121 corresponds to a position detecting means. Incidentally, the rotational speed of the fixing belt 100 is changed as described in the above-described embodiments, and therefore a relationship between the rotational speed and the value of T2/T1 at each position is obtained in advance and from this relationship, the widthwise position of the fixing belt 100 may also be specified.

However, the range of the change in rotational speed is narrow, and therefore a range of T2/T1 at each position is determined in advance, and then the widthwise position of the fixing belt 100 may also be specified from a relationship between a calculation result of T2/T1 and the range determined in advance, irrespective of the rotational speed. In this case, in consideration of a speed change, the difference in T2/T1 at each position may preferably be made large. For example, as shown in FIG. 12, the electric insulation portion 200*a* is disposed so that its length with respect to the rotational direction is different with respect to the widthwise direction. In other words, different from the shape shown in FIG. 11 in which the length with respect to the rotational direction is smoothly changed, the shape such that the length with respect to the rotational direction is changed stepwise is formed.

Figure 14:
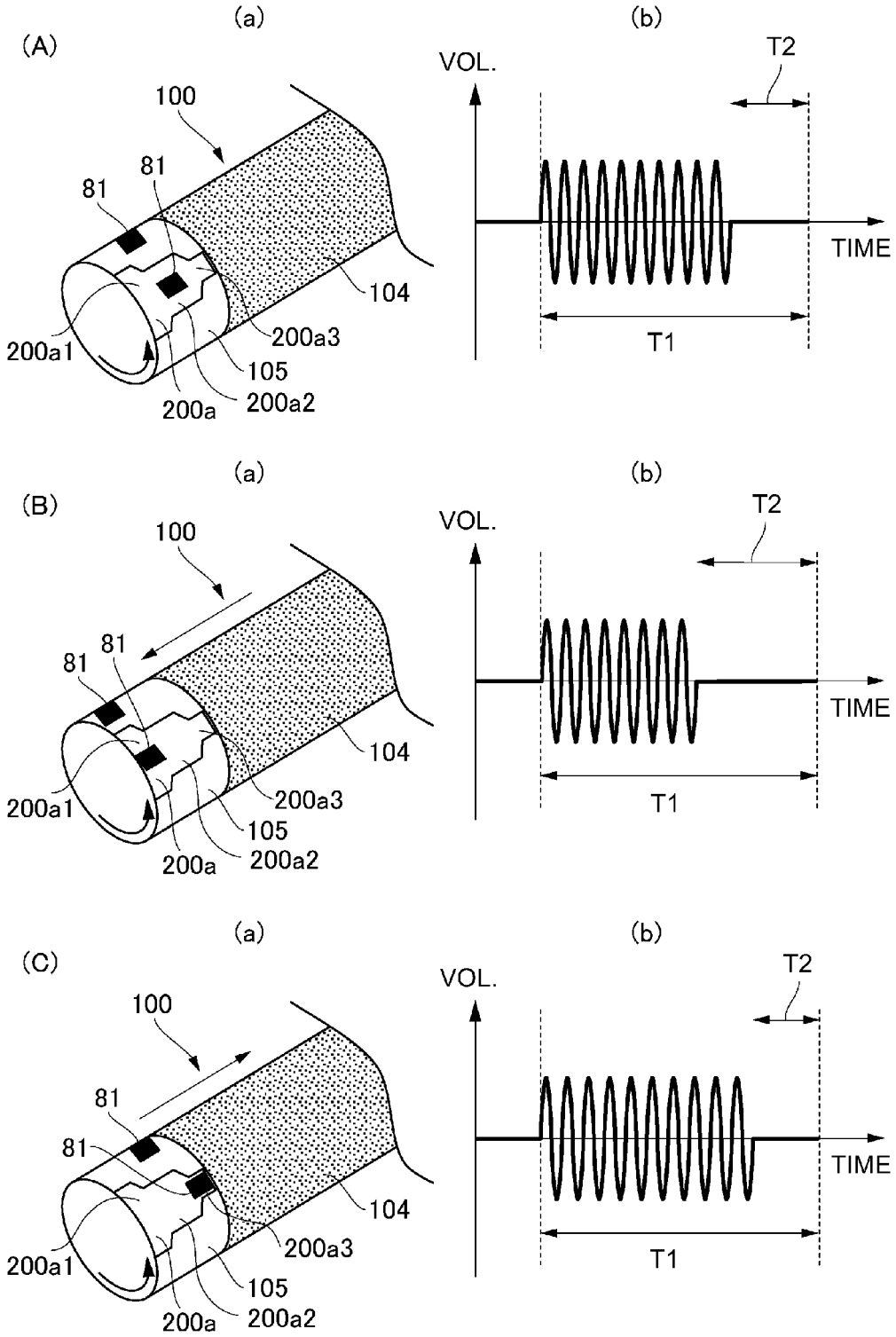
FIGS. 14(A), 14(B) and 14(C) are schematic views showing states different in widthwise position of the fixing belts, in which figure (a) of each of FIGS. 14(A), 14(B) and 14(C) is a schematic perspective view showing the fixing belt and a constitution relating to supply of electric energy, and figure (b) of each of FIGS. 14(A), 14(B) and 14(C) is a schematic view showing a relationship between a-time and a voltage signal detected by a voltage detecting portion at an associated position.

Hereinbelow, the detection of the widthwise position of the fixing belt 100 (lateral deviation detection) will be described with reference to FIG. 14. In FIG. 14, an electric insulation portion 200*a* having the same shape as that in FIG. 12 is provided.

When the fixing belt 100 is rotated at a position of FIG. 14(A)(a), the electric energy supplying member 81 passes through a detecting portion 200*a*2, and therefore the a-detection signal by the voltage detecting portion 78 shows a voltage detection waveform as shown in FIG. 14 (A)(b). From this state, when the fixing belt 100 is laterally deviated (shifted) on one side of the widthwise direction as shown in FIG. 14 (B)(a), the electric energy supplying member 81 passes through a detecting portion 200*a*1, and therefore the detection signal by the voltage detecting portion 78 shows a voltage detection waveform as shown in FIG. 14 (B)(b). Here, the detecting portion 200*a*1 of FIG. 14 (B)(a) is longer in length with respect to the rotational direction than that of the detecting portion 200*a*2 of FIG. 14 (A)(a) and therefore the value of T2/T1 calculated by the CPU 121 becomes large.

On the other hand, from a state of FIG. 14 (A)(a), when the fixing belt 100 is laterally deviated (shifted) in another side of the widthwise direction as shown in FIG. 14 (C)(a), the electric energy supplying member 81 passes through a detecting portion 200*a*3, and therefore the detection signal by the voltage detecting portion 78 shows a voltage detection waveform as shown in FIG. 14 (C)(b). Here, the detecting portion 200*a*3 of FIG. 14 (C)(a) is shorter in length with respect to the rotational direction than that of the detecting portion 200*a*2 of FIG. 14 (A)(a) and therefore the value of T2/T1 calculated by the CPU 121 becomes small.

In this way, the value of T2/T1 is changed depending on the widthwise position of the fixing belt 100 and therefore the widthwise position of the fixing belt 100 can be specified from the value of T2/T1. Incidentally, a minimum length of the electric insulation portion 200*a* with respect to the rotational direction may desirably be such that a length portion corresponding to at least one or two phases of the AC waveform is not electrically conductive in the case where the power supplying portion 79 is the AC power source. Further, also in this embodiment, the DC power source may also be used as the power supplying portion 79. Also in this case, a value corresponding to the value of T2/T1 is calculated from the rectangular waveform as shown in FIG. 6, and thus the widthwise position of the fixing belt 100 can be similarly detected.

[Lateral Deviation Control of Fixing Belt]

Next, the lateral deviation control of the fixing belt 100 effected on the basis of the above-described detection of the widthwise position of the fixing belt 100 will be described will be described with reference to FIGS. 15 to 17. In this embodiment, the CPU 121 as the control means effects control so that the fixing belt 100 travels in a predetermined zone with respect to the widthwise direction. Specifically, on the basis of an output of the voltage detecting portion 78 when the electric energy supplying member 81 contacts one of the three detecting portions 200*a*1, 200*a*2 and 200*a*3, a position of a non-driving side bearing 210 for supporting an end portion of the rotation shaft of the pressing roller 110 is changed in the recording material conveyance direction. As a result, the relationship between the rotation shaft of the fixing belt 100 and the rotation shaft of the pressing roller 110 is slightly changed, so that the widthwise position of the fixing belt 100 can be changed.

Figure 15:
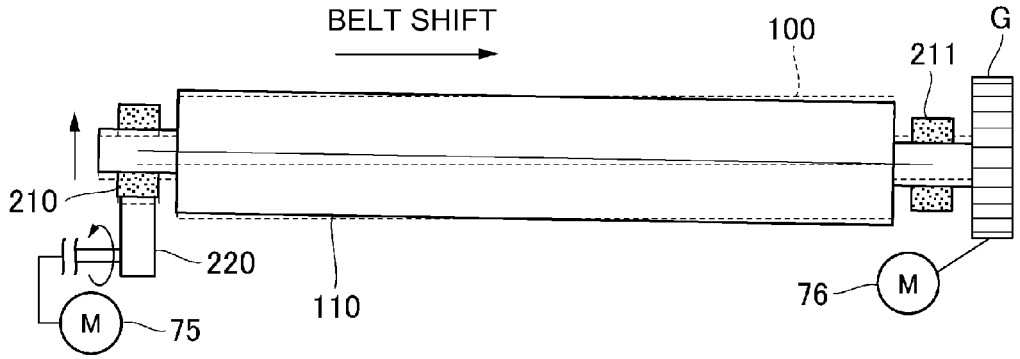
Figure 15:
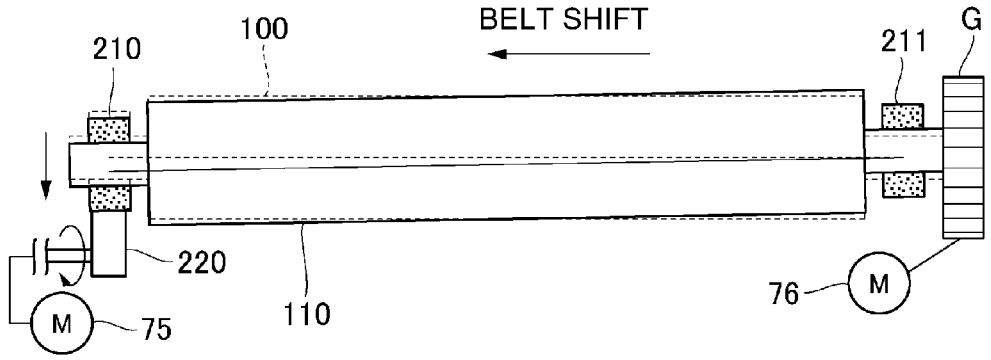

As shown in FIGS. 15 (A) and (B), the rotation shaft of the pressing roller 110 is rotatably supported by the bearing 210 at its one end portion and by a bearing 211 at its another end portion. In another end side of the rotation shaft, a reduction gear G for reducing the rotational speed of the fixing motor 76 and for transmitting a rotational force from the fixing motor 76 is fixed. Further, in one end side of the rotation shaft, the pressing roller 110 is swingably supported.

The bearing 210 for supporting one end portion of the rotation shaft is disposed movably in an arrow direction in FIGS. 15(A) and (B), i.e., the recording material conveyance direction. Further, to the bearing 210, a cam 220 is contacted. The cam 220 moves the bearing 210 in the arrow direction of FIG. 15, i.e., in the recording material conveyance direction. As a result, one end portion of the rotation shaft of the pressing roller 110 supported by the bearing 210 is moved, so that the relationship between the rotation shaft of the fixing belt 100 and the rotation shaft of the pressing roller 110 is changed. Thus, the widthwise position of the fixing belt 100 is adjusted. In this embodiment, a stepping motor 75 and the cam 220 correspond to a position adjusting means. Incidentally, the positional adjustment of the fixing belt 100 with respect to the widthwise direction may also be made by moving the bearing 210, e.g., by another actuator such as a ball screw mechanism.

Figure 16:
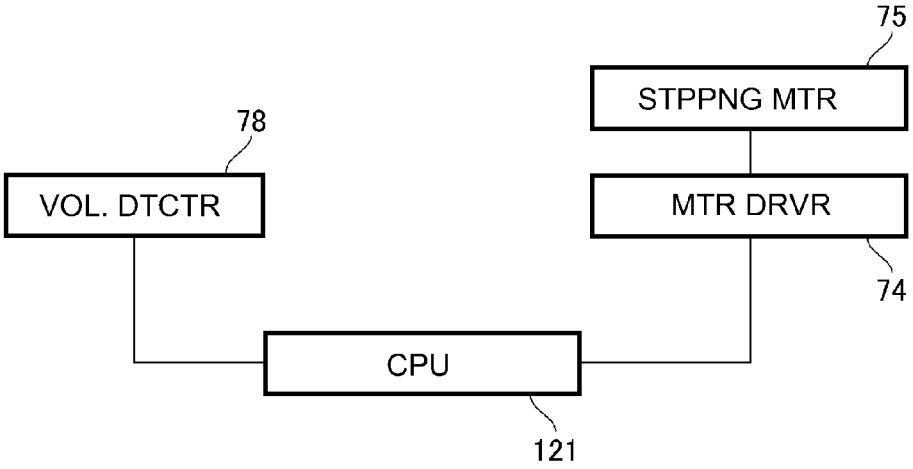
FIG. 16 is a block diagram of positional control of the fixing belt with respect to the widthwise direction in the Third Embodiment.

The stepping motor 75 is, as shown in FIG. 16, controlled by the CPU 121 via the motor driver 74. The CPU 121 specifies the laterally deviated position of the fixing belt 100 from the detection signal of the voltage detecting portion 78 as described above, and controls the stepping motor 75 so that the laterally deviated position of the fixing belt 100 is changed to a proper position. In this embodiment, the CPU 121 corresponds to the position adjusting means.

Figure 17:
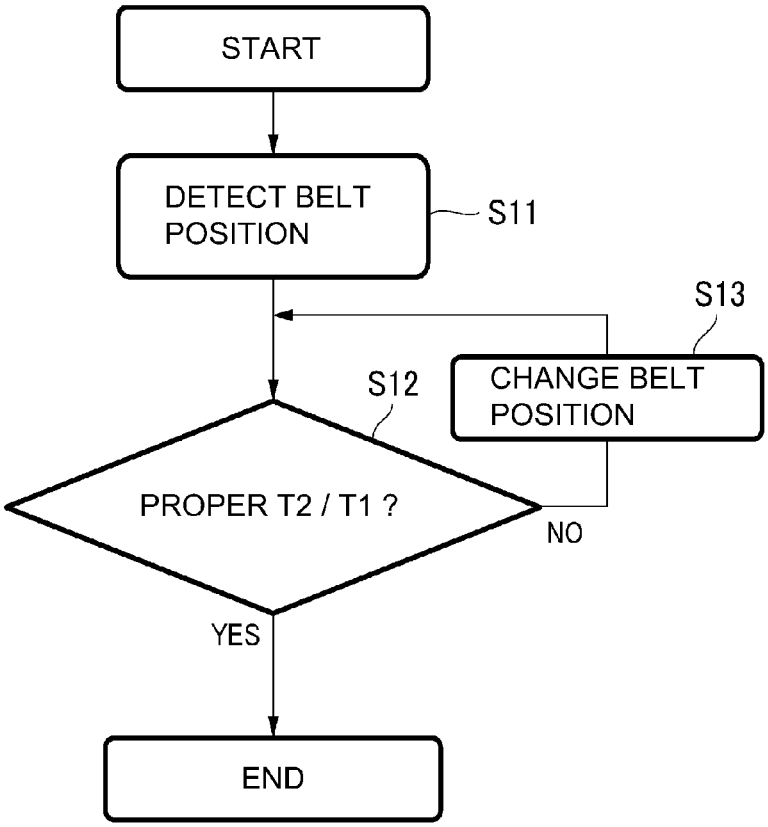
FIG. 17 is a flow chart of the positional control of the fixing belt with respect to the widthwise direction in the Third Embodiment.

The lateral deviation control of the fixing belt 100 is effected along a flow, e.g., as shown in FIG. 17. First, when the fixing belt 100 is rotated, the widthwise position of the fixing belt 100 is detected by the voltage detecting portion 78 (S11). Next, from a signal detected by the voltage detecting portion 78, the CPU 212 discriminates whether or not the calculated value of T2/T1 is in a predetermined range (S12). In the case where the value of T2/T1 is not in the predetermined range, the stepping motor 75 is driven to change the position of the fixing belt 100 (S13).

That is, in the case where the fixing belt 100 is laterally shifted in a left direction in FIG. 15, the cam 220 is rotated to move one end portion of the pressing roller 110 (in the bearing 210 side) In the narrow direction as shown in FIG. 15(A). As a result, the fixing belt 100 is moved in a right direction of FIGS. 15(A) and (B).

On the other hand, in the case where the fixing belt 100 is laterally shifted in a right direction in FIG. 15, the cam 220 is rotated to move one end portion of the pressing roller 110 (in the bearing 210 side) In the narrow direction (opposite to the arrow direction in FIG. 15(A)) as shown in FIGS. 15(B). As a result, the fixing belt 100 is moved in the left direction of FIGS. 15(A) and 15(B).

When an amount in which the position of the bearing 210 of the pressing roller 110 by the cam 220 is changed is large, the fixing belt 100 is abruptly laterally shifted toward the opposite side. For this reason, a minimum amount in which the position of the bearing 210 can be changed may desirably be 0.1 mm to 0.2 mm.

According to this embodiment, the voltage detecting portion 78 detects the electric energy supply state between the electric energy supplying member 81 and the electric insulation portion 200*a*, so that the contact of the electric energy supplying member 81 with any one of the plurality of the detecting portions 200*a*1, 200*a*2 and 200*a*3 of the electric insulation portion 200*a* provided at a part of the peripheral surface of the electrode portion 105 can be detected. For this reason, without separately providing a sensor, the widthwise position of the fixing belt 100 can be detected as described above. As a result, it becomes possible to detect the widthwise position of the fixing belt 100 in a structure in which the fixing device 5, and by extension to the image forming apparatus, can be downsized.

Incidentally, also in this embodiment, similarly as in the above-described embodiments, it is also possible to calculate the rotational speed of the fixing belt 100 from the detection signals of the electrode portion 105 and the electric insulation portion 200.

Fourth Embodiment

The Fourth Embodiment of the present invention will be described with reference to FIG. 18. In a constitution of this embodiment, different from the Third Embodiment described above, a plurality of electric energy supplying portions as the electric energy supplying member are provided with respect to the widthwise direction of the fixing belt 100 to detect the widthwise position of the fixing belt 100. In the following, constituent elements (portions) that are the same as those in the Third Embodiment are represented by the same reference numerals or symbols to omit or simplify description thereof by omitting the drawings, and the description will be made principally with respect to a difference from Third Embodiment.

Figure 18:
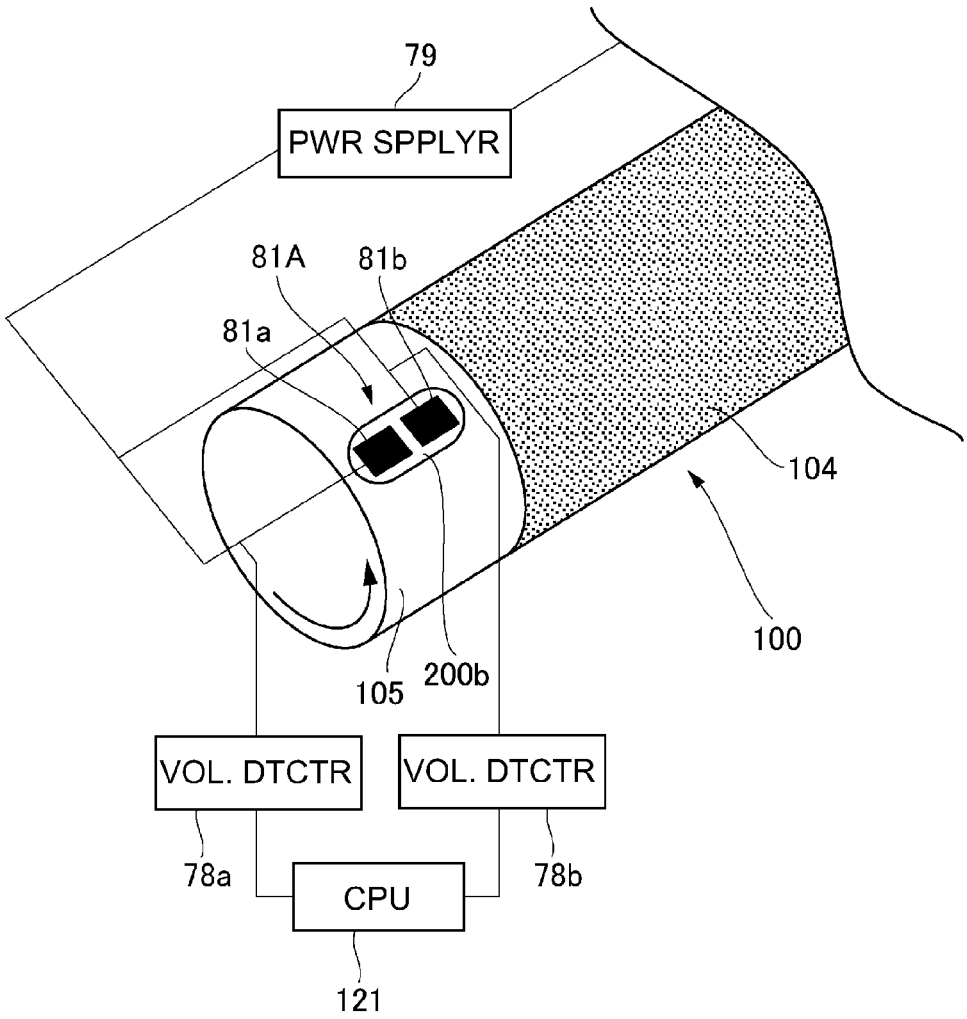
FIG. 18 is a schematic perspective view showing a fixing belt and a constitution relating to supply of electric energy in the Fourth Embodiment.

As shown in FIG. 18, an electric energy supplying member 81A provided at one electrode portion 105 includes a first electric energy supplying portion 81*a* and a second electric energy supplying portion 81*b* which are provided at different positions with respect to the widthwise direction of the fixing belt 100. Each of the first and second electric energy supplying portions 81*a* and 81*b* has the same constitution as that of the electric energy supplying member 81 in each of the above-described embodiments.

In this embodiment, voltage detecting portions 78*a* and 78*b* are provided. The voltage detecting portion 78*a* as a first voltage detecting member detects the electric energy supply state between the first electric energy supplying portion 81*a* and the electric insulation portion 200*b* and between the first electric energy supplying portion 81*a* and the electrode portion 105. The voltage detecting portion 78*b* as a second voltage detecting member detects the electric energy supply state between the second electric energy supplying portion 81*b* and the electric insulation portion 200*b* and between the second electric energy supplying portion 81*b* and the electrode portion 105. These voltage detecting portions 78*a* and 78*b* constitute the detecting means, and detect contact of the first electric energy supplying portion 81*a* with the electric insulation portion 200*b* and contact of the second electric energy supplying portion 81*b* with the electric insulation portion 200*b*, respectively.

The shape of the electric insulation portion 200*b* is such that a length with respect to the widthwise direction is slightly larger than an interval between the first and second electric energy supplying portions 81*a* and 81*b*. Further, the electric insulation portion 200*b* is disposed so that either one or both of the first and second electric energy supplying portions 81*a* and 81*b* are detectable depending on the widthwise position of the fixing belt 100.

The CPU 121 as the position detecting means detects the widthwise position of the fixing belt 100 from signals detected by the voltage detecting portions 78*a* and 78*b*. That is, in the case where a position where both of the electric energy supplying portions 81*a* and 81*b* contact the electric insulation portion 200*b* is a predetermined position, when either one of the electric energy supplying portions 81*a* and 81*b* contacts the electric insulation portion 200*b*, the position of the fixing belt 100 is deviated from the predetermined position of the fixing belt 100. Accordingly, the laterally deviated position of the fixing belt 100 is detectable from the signals from the first and second electric energy supplying portions 81*a* and 81*b*. Then, on the basis of a detection result, similarly as in the Third Embodiment, the lateral deviation control of the fixing belt 100 is effected.

Incidentally, in FIG. 18, the length of the electric insulation portion 200*b* with respect to the rotational direction is not substantially changed with respect to the widthwise direction but may also be changed as in Third Embodiment. As a result, when the value of T2/T1 is calculated with respect to each of the first and second electric energy supplying portions 81*a* and 81*b*, it is possible to detect the widthwise position of the fixing belt 100 with high accuracy.

Further, the number of the electric energy supplying portions may also be increased with respect to the widthwise direction. Further, when the plurality of the electric energy supplying portions are disposed and deviated from each other with respect to the rotational direction, an effect similar to that in Second Embodiment can also be obtained. Further, also in this embodiment, similarly as in the above-described embodiments, it is also possible to calculate the rotational speed of the fixing belt 100 from the detection signals of the electrode portion 105 and the electric insulation portion 200*b*.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 058707/2012 filed Mar. 15, 2012, which is hereby incorporated by reference.

What is claimed is:

1. An image heating apparatus comprising:

an endless belt configured to heat a toner image on a sheet at a nip, said endless belt including a heat generating layer configured to generate heat by electric energy and a conductive layer configured to be electrically connected to said heat generating layer;

an electric contact portion provided to be in contact with said conductive layer and configured to supply the electric energy to said conductive layer;

first and second electric insulation portions provided at positions where they are contactable to said electric contact portion with rotation of said endless belt and configured to be substantially electrically insulated, wherein said first and second electric insulation portions are provided so that lengths thereof with respect to a circumferential direction of said endless belt are different from each other;

a detecting portion configured to detect whether an electric conduction state between said electric contact portion and said conductive layer is in a predetermined state or not when said endless belt is rotated; and a control portion configured to control a widthwise position of said endless belt using an output of said detecting portion.

2. An apparatus according to claim 1, wherein said control portion controls the widthwise position of said endless belt on the basis of a time interval in which said detection portion detects that the electric conduction state between said electric contact portion and said conductive layer is not in the predetermined state.

3. An apparatus according to claim 2, further comprising another electric contact portion configured to supply the electric energy to said conductive layer in contact with said conducting layer when said electric contact portion contacts said electric insulation portion.

4. An apparatus according to claim 1, further comprising another electric contact portion configured to supply the electric energy to said conductive layer in contact with said conducting layer when said electric contact portion contacts said electric insulation portion.

5. An apparatus according to claim 1, wherein said first and second electric insulation portions are provided continuously.

6. An image heating apparatus comprising:

an endless belt configured to heat a toner image on a sheet at a nip, said endless belt including a heat generating layer configured to generate heat by electric energy and a conductive layer configured to be electrically connected to said heat generating layer;

an electric contact portion provided to be in contact with said conductive layer and configured to supply the electric energy to said conductive layer;

first and second electric insulation portions provided at positions where they are contactable to said electric contact portion with rotation of said endless belt and configured to be substantially electrically insulated, wherein said first and second electric insulation portions are provided so that lengths thereof with respect to a circumferential direction of said endless belt are different from each other;

a detecting portion configured to detect a time interval in which an electric conduction state between said electric contact portion and said conductive layer is not established when said endless belt is rotated; and a control portion configured to control a widthwise position of said endless belt using an output of said detecting portion.

7. An apparatus according to claim 6, further comprising another electric contact portion configured to supply the electric energy to said conductive layer in contact with said conducting layer when said electric contact portion contacts said electric insulation portion.

8. An apparatus according to claim 6, further comprising another electric contact portion configured to supply the electric energy to said conductive layer in contact with said conducting layer when said electric contact portion contacts said electric insulation portion.

9. An apparatus according to claim 6, wherein said first and second electric insulation portions are provided continuously.

* * * * *